United States Patent [19]

Rao

[11] 4,274,811

[45] Jun. 23, 1981

[54] WAVE COMPRESSOR TURBOCHARGER

[75] Inventor: V. Durga Nageswar Rao, Bloomfield Hills, Mich.

[73] Assignee: Ford Motor Company, Dearborn, Mich.

[21] Appl. No.: 32,324

[22] Filed: Apr. 23, 1979

[51] Int. Cl.[3] ..... F04F 11/00

[52] U.S. Cl. ..... 417/64

[58] Field of Search ..... 407/64; 60/39.45

[56] References Cited

U.S. PATENT DOCUMENTS

| | | | |
|---|---|---|---|
| 2,675,173 | 4/1954 | Jendrassik | 417/64 |
| 3,431,747 | 3/1969 | Hashemi et al. | 417/64 X |
| 3,591,313 | 7/1971 | Wunsch | 417/64 |
| 4,123,200 | 10/1978 | Horler et al. | 417/64 |

*Primary Examiner*—Carlton R. Croyle
*Assistant Examiner*—Edward Look
*Attorney, Agent, or Firm*—Donald J. Harrington; Frank G. McKenzie

[57] ABSTRACT

A turbocharger for compressing air on the air inlet side of a fuel air combustor or in the air intake manifold of an internal combustion engine of a compression ignition engine whereby the exhaust energy of the exhaust gases for the engine is used to boost the intake manifold pressure or the combustor air inlet pressure, the turbocharger having a rotor with multiple air and gas cells situated in a shroud so that the cells communicate through ported stators with air inlet and exhaust ports and gas inlet and exhaust ports, pressure waves established in the cells effecting compression of the inlet air for the engine, the materials used for the rotor and the shroud being closen to effect a minimum, uniform running clearance therebetween to reduce leakage and improve operating efficiency, the running clearance between the stators on either side of the rotor and the rotor itself being minimized by the use of an abradable seal.

8 Claims, 19 Drawing Figures

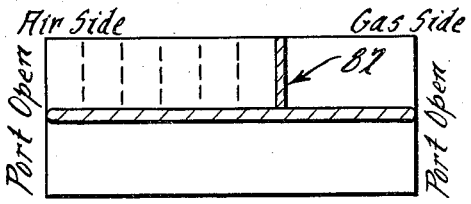

Gas Ex. Port Open
(Begins To Close)
Air Inlet Port Open
Air Fills In

FIG. 11A.

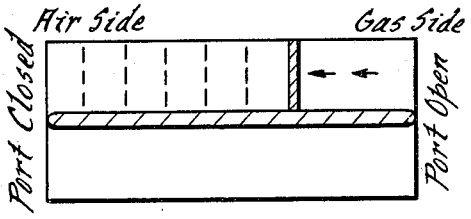

Gas Exhaust Port And Air Inlet Port Close. Gas Inlet Port Open Air Compressed As Gas Fills In

FIG. 11B.

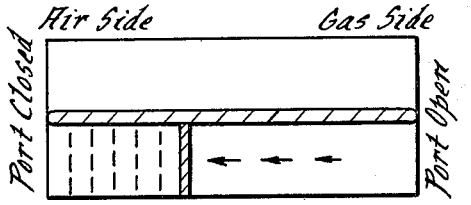

As Air Is Compressed, Gas Inlet Port Closes

FIG. 11C.

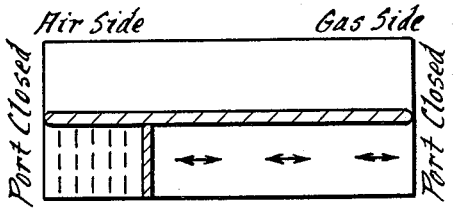

Gas And Air Inlet Ports Closed Air Is Compressed When The Cycle Is Complete
Air Outlet Begins To Open

FIG. 11D

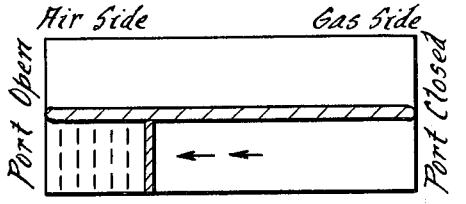

Air Outlet Port Open, Air Leaves: Expanding The Gas. Gas Inlet Still Closed, Gas Exhaust Port Is Still Closed But About To Open.

FIG. 11E.

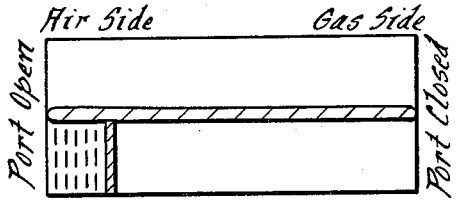

Air Exhausts And Gas Expands To Max Permissable State Without Mixing: Air Outlet Valve Begins To Close, Gas Exhaust Begins To Open

FIG. 11F.

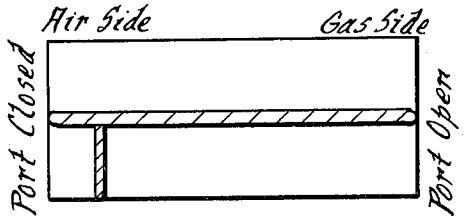

Gas Exhaust Is Open As Gas Leaves Air Inlet Begins To Open.

FIG. 11G.

WAVE COMPRESSOR TURBOCHARGER

BRIEF DESCRIPTION OF THE INVENTION

My invention comprises improvements in a comprex type supercharger of the kind that is described, for example, in a publication of the American Society of Mechanical Engineers, dated Sept. 18–22, 1977, entitled "Performance and Sociability of Comprex Supercharged Diesel Engines" by Groenewold et al of Cummins Engine Company of Columbus, Ind.

The turbocharger of my invention is shown in an environment that includes a throttle valve controlled intake manifold for an internal combustion engine. The turbocharger comprises a rotor mounted for rotation about a rotor axis that coincides with the geometric axis of a cylindrical shroud that surrounds the rotor. The rotor is formed with cells that extend in the direction of the axis of the rotor and which are arranged angularly, one with respect to the other, within the shroud. The cells and the shroud form gas flow passages for the exhaust gas and air flow passages for the inlet air.

Stator plates are situated on each axial side of the rotor and they are provided with ports which control distribution of exhaust gases into and out of the cells as well as distribution of air from an air intake port to the cells and from the cells to an air exit port, the latter communicating with the engine intake manifold. The cell characteristics and the relationship between the cells and the ports in the stator plates are carefully chosen so that a pressure wave is established at the high pressure, hot exhaust gas port and the energy of that wave is used to compress air that enters the cells through the air intake port.

The timing of the opening and the closing of the four ports is such that the pressure wave compresses the engine intake air while the reflection of the high pressure wave off the air side port wall is avoided; and the discharge of the cooled or expanded exhaust gases through an exhaust gas exit port can be achieved in proper timed relationship whereby the energy in the hot exhaust gases is used to establish compression of the air intake, the transfer of energy from the exhaust gases to the intake air being accompanied by a relatively cool exhaust gas outlet flow through the exhaust gas outlet port.

I have selected the materials for the rotor and the shroud so that a minimum and relatively constant clearance exists between these two members, thereby reducing leakage to a minimum and improving the efficiency of the turbocharger. The shroud operates with a relatively uniform temperature throughout the major axial extent of the cells, and this is in contrast to the temperature variation in an axial direction in the rotor. Notwithstanding this differential temperature between the rotor and the shroud and notwithstanding the relatively high temperature gradient across the rotor with respect to the temperature gradient on the shroud, I have achieved relatively uniform running clearances between the shroud and the rotor by judicious selection of the materials. For example, one such combination of materials that has been used successfully is a lithium aluminum silicate material (beta spodumene) for the rotor and a magnesium aluminum silicate (cordierite) for the shroud. Another possible combination of materials would be magnesium aluminum silicate for the rotor and silicone nitrite ($Si_3N_4$) for the shroud. Another possible combination of materials is silica nitrite ($Si_3N_4$) for the rotor and zirconia (porous alumina) for the shroud.

If it is desired to use metallic materials rather than ceramic materials, the rotor may be formed of stainless steel and the shroud can be formed of stainless steel with a higher coefficient of thermal expansion. Other possible metallic materials are INVAR for the rotor and 430 stainless steel for the shroud, Fecraloy for the rotor and 304 stainless steel for the shroud and Inco X 750 for the rotor 310 stainless steel for the shroud.

An abradable seal between the stator and the rotor provides minimum running clearances between those parts. The seal may be formed of a mixture of graphite and porous aluminum oxide $Al_2O_3$, or a porous felt that includes MAS or aluminum silicate material, or nickel coated graphite.

BRIEF DESCRIPTION OF THE FIGURES OF THE DRAWINGS

FIGS. 11A, 11B, 11C, 11D, 11E, 11F and 11G are schematic diagrams that show the mode of propagation of the wave front in the individual cells during operation of the assembly of FIGS. 1 and 2.

PARTICULAR DESCRIPTION OF THE INVENTION

Figure 1:
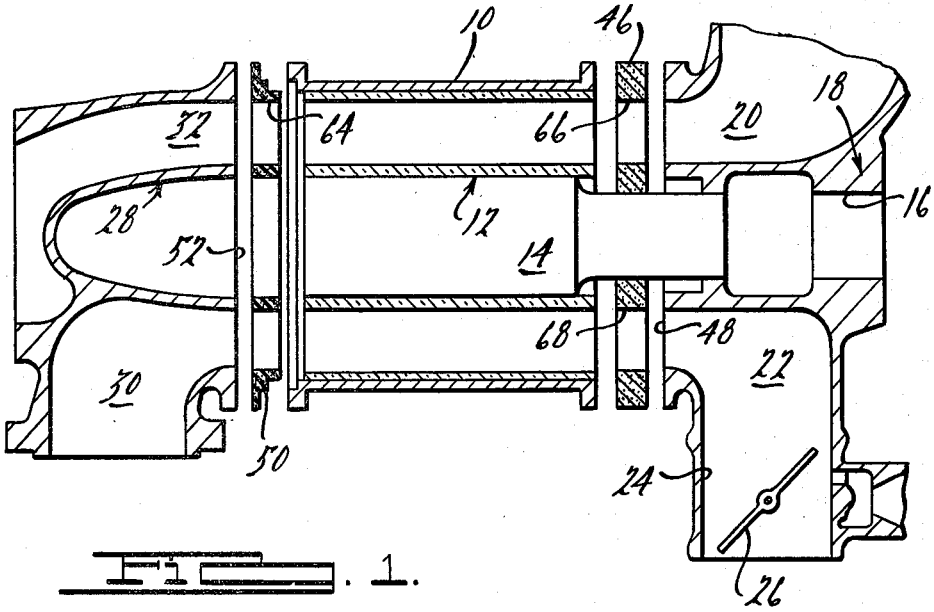
FIG. 1 is a schematic cross-sectional view of a turbocharger of my invention for use with the intake manifold of an internal combustion engine.

The improved wave compressor turbocharger of my invention uses a rotor with axially extending cells. The rotor is mounted for rotation within a cylindrical shroud. A first stator plate is located between one end of the rotor and an adjacent air intake manifold for an internal combustion engine. Another stator plate is located between the other end of the rotor and an exhaust gas manifold for the engine. The stator plates are ported to permit communication with the air ports of the intake manifold and the gas ports of the exhaust manifold. The ports are strategically positioned to provide communication between the cells and the high pressure exhaust gas passage and the low pressure exhaust gas passage on the gas side of the compressor and to provide communication between the cells and the low pressure air passage and the high pressure air passage on the air side of the compressor.

The compressor porting and the cell characteristics are designed to achieve a compression wave phenomena that effects an energy transfer from the exhaust gases to the intake manifold air. This involves a proper design of the cell geometry such as the cell length and width, wall thickness, wall surface smoothness and porosity, wall rigidity, heat conductivity and cross-sectional variation. These characteristics must be matched with the port shapes and port disposition in the stator plates. The port design determines the duration of the port closed time and the port open time on both the air side and the exhaust side. It is a function of cell geometry and pulse rate for the reflected waves in the cells.

The port opening on the gas exhaust side as well as the port opening on the air intake side similarly should be related, one with respect to the other; and this relationship between the ports is determined by the factors that will be described in the following paragraphs.

The gas intake port opening should begin just prior to the initiation of a pulse or wave front, and it should close after the wave front is created. The air intake port should close just before the opening of the gas intake port.

The air exhaust port should open at an instant after the gas intake port is closed but before the high pressure wave front reaches the end of the cell on the air side, as mentioned previously. The air exhaust port communicates with the engine intake manifold, and the air intake port communicates with the ambient air supply.

It is important to prevent reflection of the high pressure wave off the air side port or stator wall. The air exhaust port should close when the high pressure wave impinges on the air side port wall. If a degree of exhaust gas recirculation is desired, the closing of the air exhaust port can be timed so that a portion of the high pressure exhaust gas reaches that port before it is closed. Exhaust gas recirculation is one design expedient that is used in present production automobile engines to reduce undesirable exhaust gas emissions.

The exhaust gas port should be opened at an instant just prior to the opening of the air intake port. Timing of the closing of the air exhaust port and the opening of the gas exhaust port control to a great extent the air losses and, therefore, have an effect on the efficiency of the compressor.

Although the port timing can be designed to achieve a degree of exhaust gas recirculation as explained above for the purpose of reducing undesirable exhaust gas emissions and to minimize air losses, the timing should be designed so that the pressurized air is cooled before it enters the intake manifold. The cooling may reduce the pressure of the air, and this factor should be considered in matching a turbocompressor with an internal combustion engine intake manifold. Such cooling might be less critical and more desirable in the case of a fuel injection type engine and could actually increase the engine efficiency in the case of diesel engines. In aspirated gasoline engines, however, a balance or design compromise should be made between the horsepower air losses, reduced compressor efficiency and the desirability of cooling the engine intake air.

The timing of the opening and the closing of the ports, as above explained, thus determines the actual performance of the compressor and the efficiency of the energy exchange as well as nonleakage type air losses. The closing of the exhaust gas outlet port should coincide ideally with the end of the low pressure wave travel and the filling of the cells with air.

Since there is always mixing, the air-gas boundary is diffused rather than finite. It is, therefore, inevitable that some of the air should escape. The factors that affect this loss are those factors that affect the propagation of the low pressure wave and the mixing of the air and the gas at the intake air front. Although the timing of the opening and closing of the exhaust gas inlet port is important, the timing of the opening and the closing of the air intake port and the exhaust gas outlet port, one with respect to the other, also should be properly sequenced and timed to achieve optimum results.

The timing of the porting also has an effect on the mixing and heat transfer of the gases. Such mixing and heat transfer contributes to performance losses both in the form of entropy losses as well as the loss of air through the exhaust port. The mixing losses due to the heating of the intake air by the hot exhaust gases at or near the wave front are primarily the result of diffusion of the exhaust gases as the wave front looses coherency. These losses cannot be eliminated altogether, but they can be controlled to a minimum value through the control of the port opening sequence and the port and cell geometry. Any heat transfer from the mixing will increase the volume of the intake air without an accompanying increase in the available oxygen for combustion. As mentioned earlier, any heating of the air is undesirable in aspirated type fuel systems; and it may make it necessary to use costly cooling system devices if the heating effect is excessive. Any cooling that is necessary in the case of aspirated fuel engines will result in reduced performance.

Heat retention is affected also by cell surface area and the mass of the cell material. The ideal case would be to have very large cells with very thin walls. In some instances a cell can be designed so that a stable boundary layer exists, which would in turn reduce heat retention and transfer.

The design factors that affect efficiency also may affect compressor noise caused by resonant vibration of the gases in the cells. Noise considerations should be considered with respect to the tolerable air leakage and with respect to the port configurations and clearances between the rotor and the stationary parts.

The reduction of cell wall width and the increase in cell area cannot be considered independently of the strength and rigidity requirements of the materials.

Figure 2:
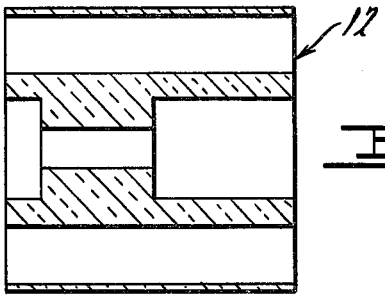
FIG. 2 is a detail view of a rotor as used in the assembly of FIG. 1.
Figure 3:
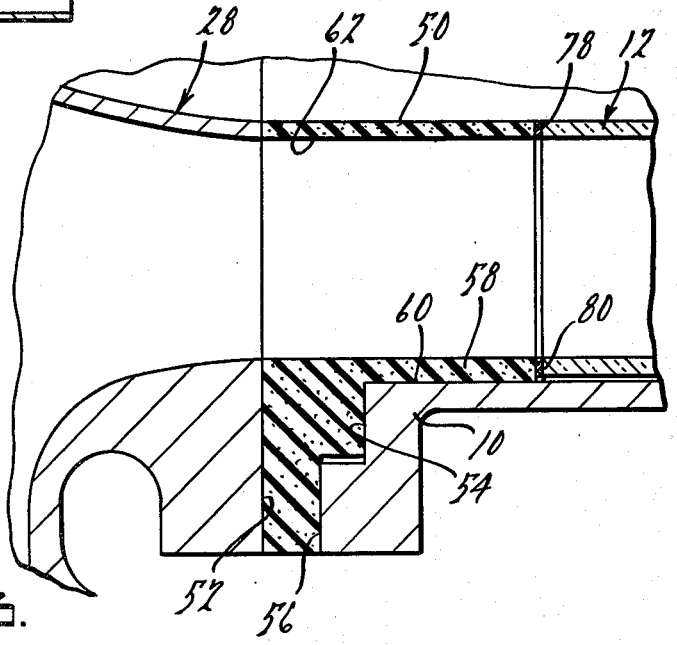
FIG. 3 is an enlarged view of a portion of the structure of FIG. 1 showing the disposition of the stator and the rotor of FIGS. 1 and 2.

For a description of a preferred embodiment of my invention, reference first should be made to FIGS. 1, 2 and 3. In FIG. 1 reference numeral 10 designates a stationary, cylindrical shroud that surrounds a rotor indicated generally by reference character 12. The rotor comprises a rotor support shaft 14 which extends through a shaft opening 16 formed in an intake manifold 18 for an internal combustion engine. The manifold 18 defines an air intake passage 20 and an air exhaust passage 22, the latter communicating with the throat 24 of the carburetor for the engine. The passage of air through the throat is controlled by the throttle valve blade 26 in known fashion.

Reference numeral 28 designates an exhaust gas manifold for the internal combustion engine. It defines a high pressure exhaust gas passage 30 and a low pressure, cooler, exhaust gas passage 32. Hot pressurized exhaust gases enter the passage 30 and are distributed to the compressor. The energy of the exhaust gases is used by the compressor to effect a pressure increase in the air; and then the expanded, cooled, exhaust gases are discharged through the passage 32. The air on which the heated, high-pressure exhaust gases act is supplied to the compressor through the passage 20. After the energy transfer from the exhaust gases to the air, the pressurized air is transferred from the compressor to the passage 22. The phenomena by which this energy transfer occurred will be described in the following paragraphs.

Figure 4:
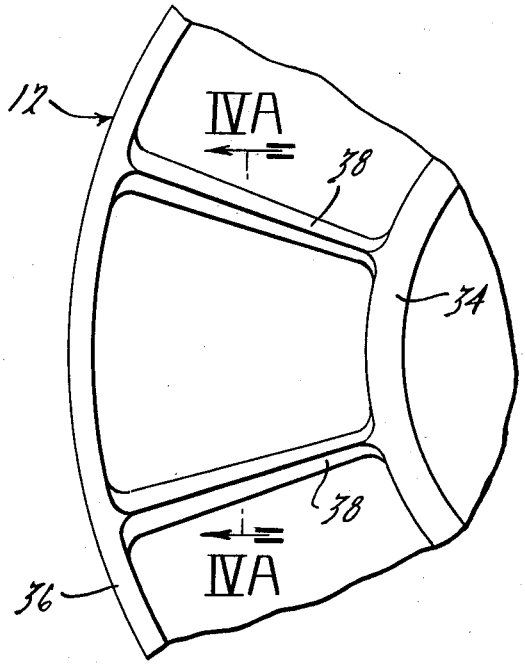
FIG. 4 is an end view of the rotor of FIGS. 1 and 2.
Figure 4A:
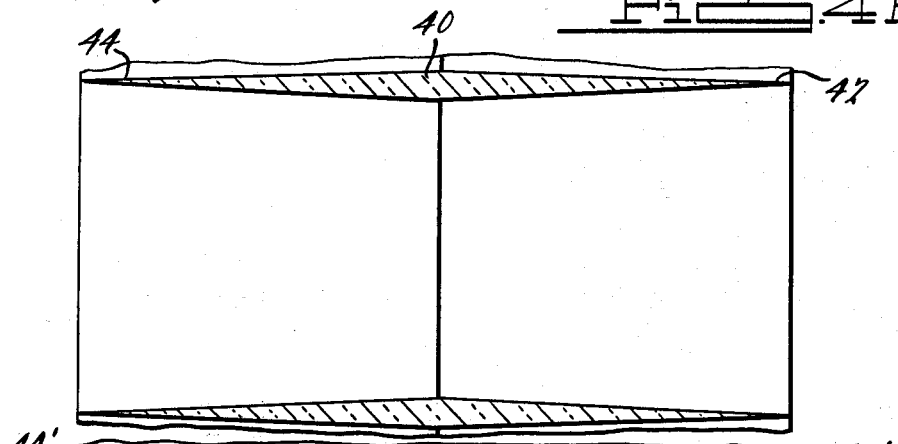
FIG. 4A is a cross-sectional view of the cells of FIG. 4 as seen from the plane of section line 4*a*—4*a* of FIG. 4.
Figure 4B:
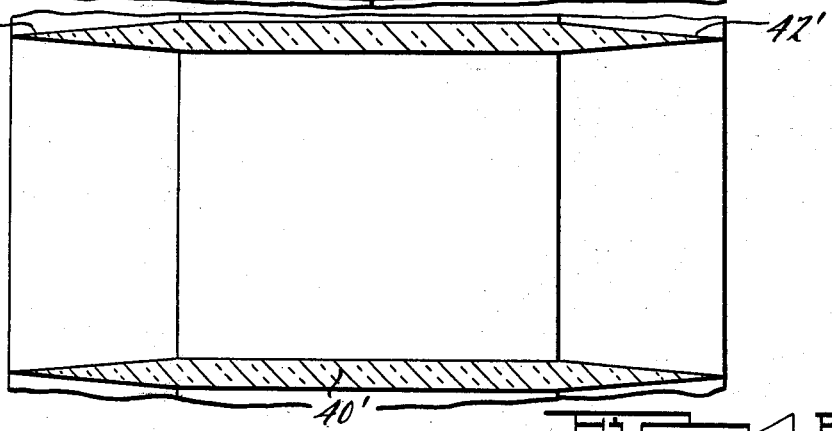
FIG. 4B is a view similar to FIG. 4A, but it shows a modified cross-sectional shape for the cell walls.

As best seen in FIG. 4, the rotor comprises a hub portion 34 and a rim portion 36. The hub and the rim are concentrically disposed, as shown, with radial webs or walls 38 situated between them. The hub 34, the rim 36 and the walls 38 define flow passages of generally tetrahedral cross section. A shape for the walls 38 that provides maximum cell cross-sectional area at each of the ports includes an enlarged center portion 40 and reduced thicknesses at each of the end portions 42 and 44. The greater thickness at the center is intended to increase the rigidity or strength of the wall. The wall thickness is reduced to the extent permitted by the strength requirements thus reducing thermal losses and thermal stresses resulting from heating of the wall surfaces by the exhaust gases. A modified form of wall design is shown in FIG. 4B where the center portion 40' is of relatively long axial extent with respect to the enlarged center portion 40 of the design of FIG. 4A. The end portions 42' and 44' of the design of FIG. 4B provide a maximum cell area in the region of the ports at either side of the rotor, but the change in cell area that exists at the compressor wave front increases more sharply as the wave front progresses toward the ports in the case of FIG. 4B in comparison with the design of FIG. 4A.

A stator plate 46 is located between the air side of the rotor 12 and the intake manifold 18. The air intake passage 20 terminates, and the air exhaust passage 22 begins at a planer surface 48 located directly adjacent the stator plate 46. In the FIG. 1 view these parts have been shown separated for purposes of clarity; but in practice, of course, the rotor, the stator and the manifold are situated in close proximity.

A gas stator plate 50 is located between the exhaust gas manifold 28 and the gas side of the rotor 12. Exhaust gas exit passage 32 begins, and the exhaust gas inlet passage 30 terminates at a planar surface 52 on the exhaust gas manifold. The surface is contacted by one side of the stator plate 50 and a minimum clearance exists between the other side of the stator plate 50 and the gas side of the rotor 12 although these parts also have been shown disassembled for purposes of clarity in FIG. 1.

In FIG. 3 I have shown the actual disposition of the exhaust manifold 28 with respect to the stator 50, the shroud 10 and the rotor 12. The stator 50 is situated between surface 52 and surface 54 of the stator 10. A stator end wall as seen best in FIG. 3 is stepped so that two end surface portions are provided as shown in 54 and 56. The periphery of the stator 50 is provided with an extension in an axial direction as shown at 58, and this registers with internal cylindrical surface 60 of the stator 10. The stator may be formed of the same material as the rotor.

The juxtaposed surfaces of the stator and the shroud as indicated by reference characters 56, 54 and 58 provide a circuitous flow path for the gases thus reducing leakage losses.

The stator 50 is provided with a high pressure exhaust gas port 62 which communicates with passage 30. It is provided also with a low pressure exhaust gas port 64 which communicates with the passage 32. In like fashion the stator 46 on the air side of the compressor is provided with a low pressure air inlet port 66 and a high pressure air outlet or exhaust port 68. Port 66 communicates with low pressure air supply passage 20, and high pressure port 68 communicates with high pressure air passage 22.

Figure 7:
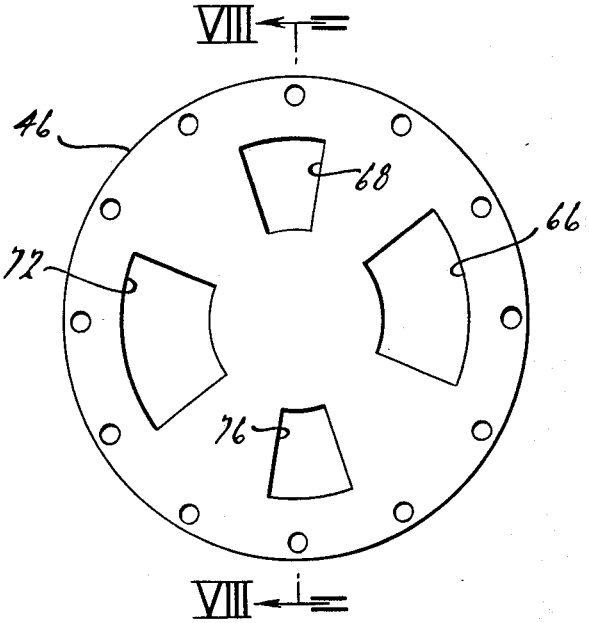
FIG. 7 is an end view of a ported stator plate for use on the air side of the assembly of FIGS. 1 and 2.
Figure 8:
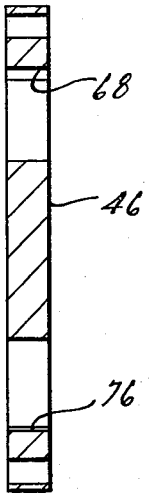
FIG. 8 is a cross-sectional view taken along the plane of section line 8—8 of FIG. 7.

FIGS. 7 and 8 show in detail a typical port arrangement for stator 46. It comprises two low pressure air outlet ports 66 and 72 and two high pressure air inlet ports 68 and 76. The inlet ports and the outlet ports are arranged strategically to provide controlled communication with the air cells in proper timed relationship. With the double porting shown in FIGS. 7 and 8, two compression cycles are achieved with each revolution of the rotor. The porting for the stator 50 may be similar, through not necessarily identical, to the porting of FIGS. 7 and 8. Stator 50 also can be provided with a double cycle porting arrangement.

As indicated best in FIG. 3, an abradable seal material is provided between the end surface of the stator 64 and the adjacent surface of the rotor as indicated at 78 and 80. Similarly, an abradable seal material is provided at the opposite end of the rotor between the end surface of the rotor on the air side and the adjacent surface of the stator 46. The abradable seal is comprised preferably of a nickel coated graphite if the stator is metal or a porous ceramic seal material if the stator is formed of ceramic. Also a porous felt material containing magnesium-aluminum-silicate or aluminum silicate powder can be used with or in the absence of graphite powder. With this seal arrangement a zero clearance condition can be provided during assembly of the rotor, the stator and the shroud. The seals will "wear in" to provide running clearances of minimum dimension when the rotor is operated.

The mode of propagation of a wave front and the energy transfer phenomena described in preceding paragraphs is illustrated schematically in the sequence diagrams of FIGS. 11A through 11G. Each of the FIGS. 11A through 11G represents a cell, and the condition that exists in each cell represents an instantaneous condition that occurs in sequence during one compression cycle, as mentioned previously. Each revolution can produce two cycles if that is desired although I contemplate that a single cycle compressor can be used by appropriately designing the porting, the numbers of cells and the cell geometry.

In FIGS. 11A through 11G the channels or cells are disposed so that the gas side ports are on the right hand side and the air side ports are on the left hand side. When a gas port is opened, the channel is filled with low pressure intake air because at that instant the air inlet port associated with that particular channel also is opened. Thus an exhaust gas and inlet air interface occurs which creates a pressure wave, the pressure of the exhaust gas being higher than the pressure at the surface of the intake air. This gas-air interface can be thought of as an imaginary piston which is illustrated in the diagrams of FIGS. 11A through 11G by a shaded imaginery wall identified for purposes of discussion by reference character 82.

In the condition shown in FIG. 11A the gas exhaust port is opened, thereby creating a moving pressure wave or piston. At the instant the gas port opens the air inlet port at the opposite end of the channel is opened. In the FIG. 11B condition the air inlet port closes as the imaginary piston begins to move in a left hand direction. As it moves in that direction, the inlet air becomes compressed and the exhaust gas port begins to close. In the FIG. 11C condition the imaginary piston has moved throughout a substantial axial extent in the channel; and at that instant the gas inlet port closes and the inertia of the moving imaginery piston continues the compression stroke. At the same time, however, the pressure of the exhaust gas behind the piston becomes reduced. In the FIG. 11D condition the air outlet port begins to open, and it is at this time that the compression cycle is complete. In the FIG. 11E condition the air outlet port is opened thus allowing the compressed air to be expanded into the compressed air outlet passage 22 of the intake manifold. The gas at that instant behind the piston continues to expand since the gas inlet port still is closed. The gas exhaust port also is closed at this time, but it is about to be opened as the rotor continues to rotate toward the gas exhaust port in the stator plate 50. In the FIG. 11F condition the air has been exhausted, and gas behind the piston has been expanded to a maximum permissible value without appreciable mixing of the air and the gas, and the air outlet port begins to close as the gas exhaust port begins to open. In the FIG. 11G condition the gas exhaust port is opened thus permitting discharge of cooler low pressure exhaust gases into the exhaust passage 32. After the exhaust gas has been discharged, the air inlet passage begins to open, thereby conditioning the rotor and the cell for the next cycle.

Figure 5:
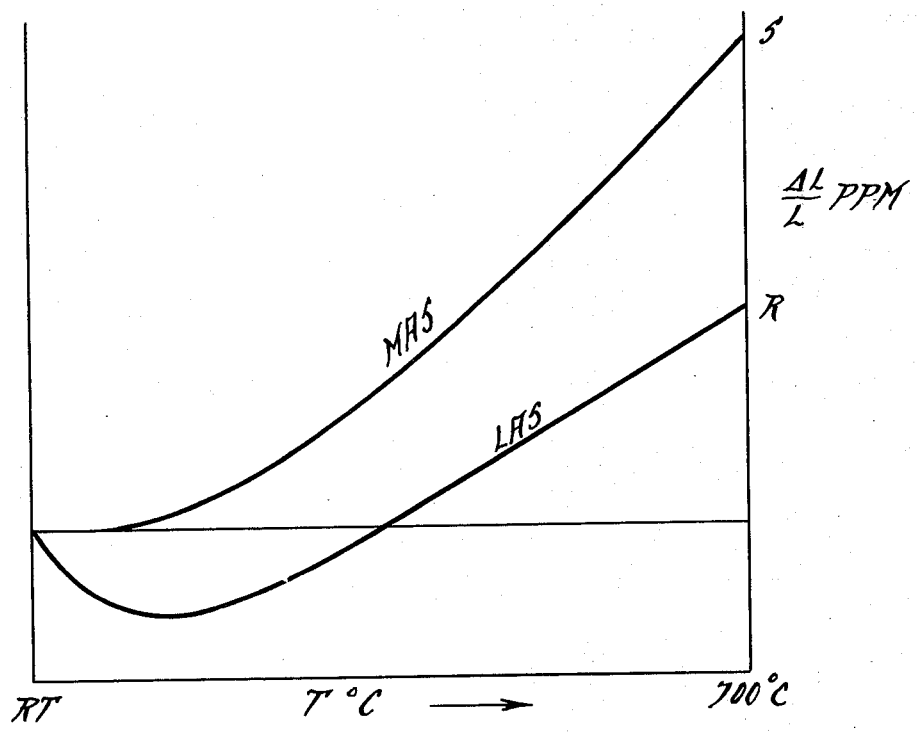
FIG. 5 is a chart that shows the thermal expansion characteristics for magnesium aluminum silicate and lithium aluminum silicate in a temperature range of 0° C. to 700° C.
Figure 6:
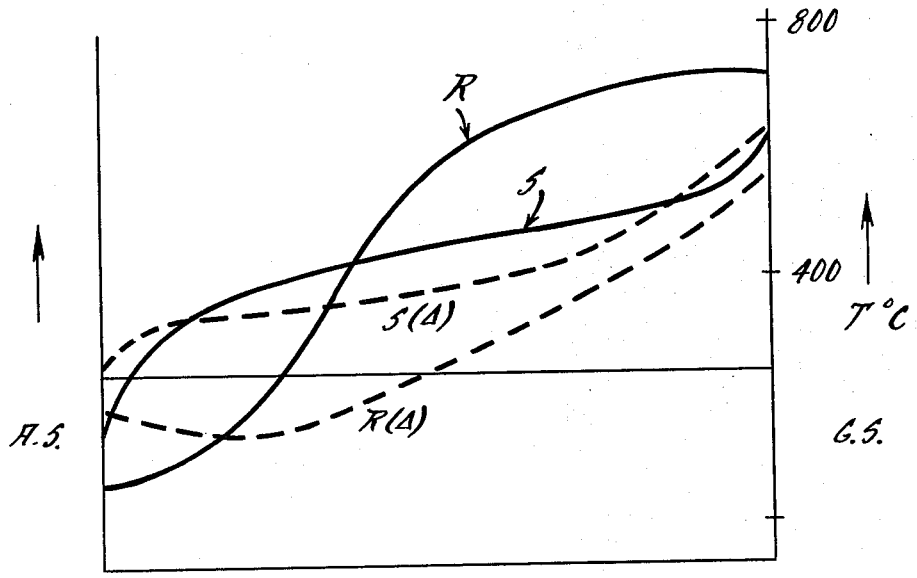
FIG. 6 is a chart that shows the expansion characteristics for the rotor of a ceramic turbocharger.

The phenomena illustrated in FIGS. 11A through 11G creates a temperature differential through the channels, and this temperature differential is illustrated in the diagram of FIG. 6. FIG. 6 represents a temperature gradient, and the linear dimension of the channel is plotted on the abscissa, and the temperature at any point on the abscissa is illustrated on the ordinate. The letter "R" represents the temperature at any axial location on the rotor and the curve labeled "S" represents the temperature at any axial location on the shroud. It will be observed from FIG. 6 that the temperature of the shroud is relatively uniform with respect to the temperature of the rotor except possibly for the two end regions on the gas side and on the air side. On the air side of the rotor the temperature on the stator falls off near the edge of the rotor because of the cooling effect of the inlet air. In contrast, the temperature of the shroud near the edge of the rotor on the gas side is increased because of its exposure to the hot exhaust gases. The temperature variation that occurs in the center regions of the cells in the rotor are very extreme. Because of this temperature variation, it becomes necessary to carefully choose the materials for the stator and the rotor in order to avoid development of excessive clearances between the rotor and the stator that would produce leakage and also to avoid interference at the running clearances between the rotor and the shroud. For this reason the materials that should be chosen should have differential expansion rates. FIG. 5 shows two materials that may be used because of their thermal expansion characteristics. Magnesium aluminum silicate can be used successfully for the shroud if it is paired with a lithium aluminum silicate ceramic for the rotor. FIG. 5 shows a thermal expansion characteristic for each of these materials, which are indicated respectively by the symbols MAS and LAS. The temperature differential that might exist in a typical installation might vary from a temperature of near 0° C. at the air side and 700° C. at the gas side. The expansion characteristics for this temperature range have been indicated in FIG. 5.

Thermal expansion of LAS material is in a negative direction. The temperature variation that occurs in FIG. 6 and the thermal expansion characteristics indicated in FIG. 5 are compatible for effecting uniform clearances because in the region to the left of the chart of FIG. 6, where the temperature of the rotor changes rapidly, the thermal expansion characteristics of the material of which the rotor is formed is of a moderate or decreasing value. It tends in that region to "grow away" from the shroud, but the change in clearance caused by that tendency is at a minimum because the shroud has a reduced expansion coefficient in that region. In contrast, in the high temperature region near the exhaust gas side the temperature of the rotor is higher than the temperature of the stator; but since the stator material has a higher coefficient of thermal expansion relative to the coefficient of thermal expansion of the rotor in that region, no appreciable change in clearance occurs.

In the dotted lines shown in FIG. 6 I have shown the change in radial dimension and axial dimension for the stator and the rotor, respectively, as shown by the symbols "S" and "R." These dotted line curves at the right hand side of the chart are relatively close together and have generally the same slope. The dotted lines at the left hand side of FIG. 6, although not precisely parallel, do indicate that the differential expansions due to temperature changes are of a reduced magnitude—at least in comparison to the differential expansion values that would occur if both the rotor and the shroud were formed of the same material.

Figure 9:
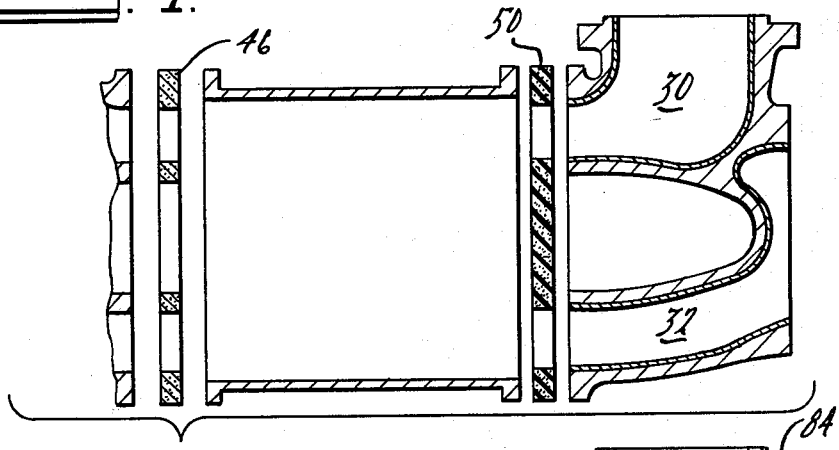
FIG. 9 is a view similar to FIG. 1 showing sound deadening ports on the gas side of the assembly and also sound deadening seals on either side of the rotor.

In FIG. 9 I have shown a material for the stator 46 that is capable of deadening sound. This may be graphoil or graphite sheet material since that side of the rotor is not subjected to high temperatures. I have shown also in FIG. 9 a porous alumina ($Al_2O_3$) or aluminum silicate fiber material for the stator 50. This also is intended to isolate noise and possibly achieve some sound deadening.

Further expedients for reducing noise level or for isolating noise also are shown in FIG. 9. This includes lining the high pressure gas passage 30, and the low pressure exhaust gas passage 32 with a porous aluminum silicate or aluminum oxide material which is bonded to the metal lining or wall of the exhaust gas manifold.

Materials for the lining or for the stator 50 may include an aluminum silicate fiber. In the case of the stator, the fiber can be impregnated with a low friction material such as zinc oxide or calcium flouride or some other low friction material.

Figure 10:
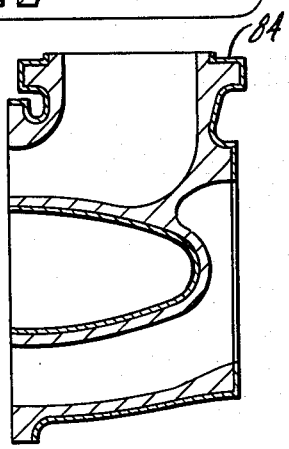
FIG. 10 is a view similar to FIG. 1 showing a porous metal port on the gas side of the assembly and a noise isolation seal on the air side.

In FIG. 10 I have shown an alternate arrangement that comprises forming the exhaust gas manifold itself with porous alumina or aluminum silicate fiber rather than providing only a lining for the passages in the exhaust manifold since it might be desirable to provide an impervious steel coating 84 around the porous metal ports on the gas side, thus providing added strength.

Having described preferred forms of my invention, what I claim and desire to secure by U.S. Letters Patent is:

1. A turbo compressor for use with an air-fuel mixture intake manifold for an engine comprising a circular rotor mounted for rotation about its geometric axis, said rotor comprising a hub and axially disposed cells formed about the periphery of the hub, a cylindrical shroud surrounding said rotor and disposed with a close tolerance clearance between the interior surface of said shroud and the outer dimension of said rotor, an exhaust gas manifold and an air intake manifold for said engine, said exhaust gas manifold having formed therein a low pressure exhaust gas passage and a high-pressure, hot exhaust gas passage, said intake manifold having a low pressure intake air passage and a high pressure air outlet passage communicating with the air intake side of the engine, a first stator plate situated between said rotor and said air intake manifold and a second stator plate situated between said exhaust gas manifold and said rotor, said first stator plate having formed therein a low pressure air inlet port and a high pressure air outlet port, said second stator plate having formed therein a low pressure exhaust gas outlet port and a high pressure exhaust gas inlet port communicating respectively with said low pressure exhaust gas passage and said high pressure exhaust gas passage, the ports in said first stator plate communicating respectively with said low pressure intake air passage and said high pressure air-outlet passage, said rotor being formed of a material that has a low coefficient of thermal expansion relative to the coefficient of thermal expansion of the material of which the shroud is formed, thereby providing minimum change in clearance between said rotor and said shroud during operation of said compressor as temperature gradients are developed during an energy exchange that exists between the hot high pressure exhaust gases and the relatively cool low pressure inlet air.

2. The combination as set forth in claim 1 wherein said rotor is formed of lithium aluminum silicate material and said shroud is formed of a magnesium aluminum silicate material.

3. The combination as set forth in claim 1 wherein the coefficient of thermal expansion of the material of which the rotor is formed is approximately 0.7 times the coefficient of thermal expansion of the material of which the shroud is formed.

4. The combination as set forth in claim 1 wherein an abradable seal material is used at the facing of the axial end of the rotor adjacent the stator whereby a running clearance of minimum tolerance can be achieved, said abradable seal being formed of a nickel coated graphite.

5. The combination as set forth in claim 1 wherein an abradable seal material is used at the facing of the axial end of the rotor adjacent the stator whereby a running clearance of minimum tolerance can be achieved, said abradable seal being formed of a porous ceramic.

6. The combination as set forth in claim 1 wherein the stator adjacent the air intake manifold is formed of sound deadening material such as graphite.

7. The combination as set forth in claim 1 wherein the stator adjacent the exhaust gas manifold is formed of a porous alumina material.

8. The combination as set forth in claim 1 wherein the wall for the high pressure exhaust gas passage and the wall for the low pressure exhaust gas passage are formed of a sound deadening material such as porous alumina.

* * * * *